US005457848A

United States Patent [19]

Miwa

[11] Patent Number: 5,457,848

[45] Date of Patent: Oct. 17, 1995

[54] RECIRCULATING TYPE CLEANER

[75] Inventor: Hirohide Miwa, Kawasaki, Japan

[73] Assignee: Tokyo Cosmos Electric Co. Ltd., Tokyo, Japan; a part interest

[21] Appl. No.: 139,714

[22] Filed: Oct. 22, 1993

[30] Foreign Application Priority Data

Oct. 26, 1992 [JP] Japan ..... 4-287278
Dec. 24, 1992 [JP] Japan ..... 4-344307

[51] Int. Cl.[6] ..... A47L 5/14

[52] U.S. Cl. ..... 15/346; 15/319; 15/420

[58] Field of Search ..... 15/319, 345, 346, 15/420

[56] References Cited

U.S. PATENT DOCUMENTS

| | | | |
|---|---|---|---|
| 1,383,455 | 7/1921 | Farnsworth | 15/346 |
| 2,064,344 | 12/1936 | Good | 15/346 |
| 2,592,710 | 4/1952 | Kirby | 15/319 |
| 3,268,942 | 8/1966 | Rossnan | 15/346 |
| 3,694,848 | 10/1972 | Alcala | 15/346 |
| 4,207,650 | 6/1980 | Crise | 15/346 X |

FOREIGN PATENT DOCUMENTS

| | | | |
|---|---|---|---|
| 977910 | 11/1975 | Canada | 15/346 |
| 1542802 | 9/1968 | France | 15/346 |
| 2455878 | 1/1981 | France | 15/346 |
| 2218351 | 11/1973 | Germany | 15/346 |

*Primary Examiner*—Chris K. Moore
*Attorney, Agent, or Firm*—Pollock, Vande Sande & Priddy

[57] ABSTRACT

A recirculating type cleaner having a dust collecting port including a suction port and an outlet in which downstream flow of a fan is recirculated, discharged through said outlet, and drawn into said suction port. Said dust collecting port means has an outer peripheral wall defining an outer boundary of said suction port. The outlet is located within the region of the suction port and has an orifice or opening so constricted as to discharge the downstream flow in the form of a jet and so oriented as to discharge the jet at an angle in the range of 90°±30° relative to a surface to be cleaned. The end surface of the boundary wall between the outlet and the suction port and/or the flange or a outer peripheral wall are formed with a plurality of minute channels.

3 Claims, 3 Drawing Sheets

FIG. 2A1
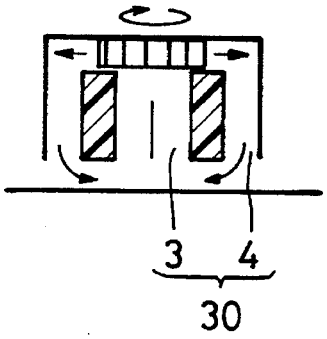
FIG. 2A2
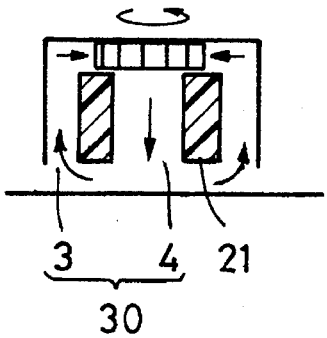
FIG. 2B
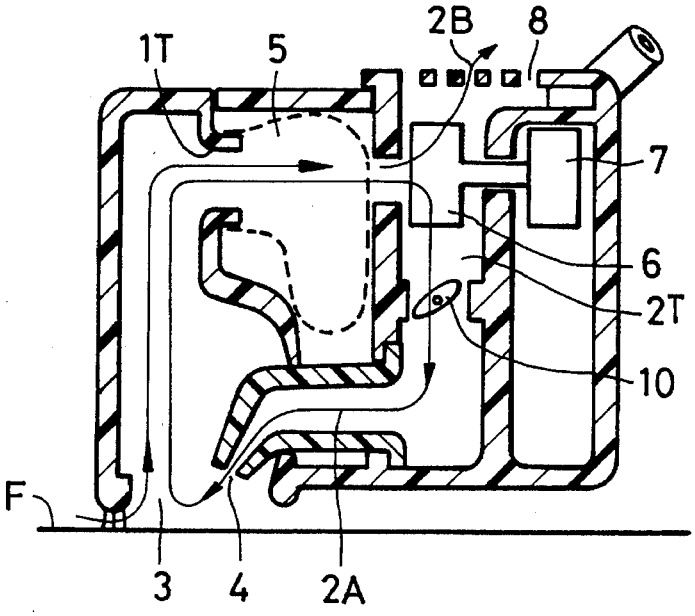
FIG. 2C
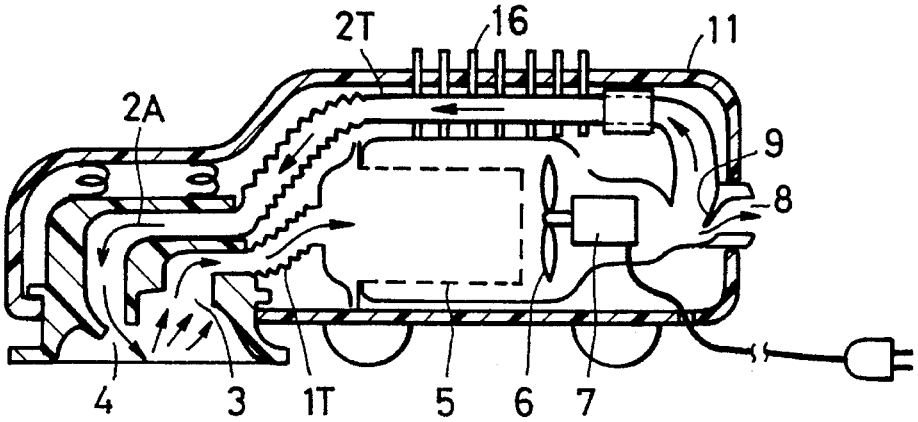

RECIRCULATING TYPE CLEANER

TECHNICAL FIELD

This invention relates generally to an electric cleaner and particularly to a recirculating type cleaner in which the air flow downstream of a suction fan (referred to as "downstream flow" hereinafter) is recirculated back to the suction port to utilize the energy of the downstream flow to reduce the noise to the exterior, prevent fine dust from being exhausted to the exterior, and improve the cleaning efficiency per unit electric power.

BACKGROUND ART

Various approaches to making use of the downstream flow energy have been proposed by the prior art as illustrated in FIGS. 1A–1E and 2A–2C.

Approach 1

As schematically shown in FIG. 1A, for example, one approach is to employ the downstream flow 2A to rotate a turbine impeller 13 which in turn rotates a rotary brush 12 for removing dust, dirt or refuse. An example of this approach is disclosed in Japanese utility model publication Kokoku No. 39-36553 published on Jul. 7, 1962.

Approach 2

As schematically shown in FIG. 1B, for example, another approach is characterized by driving a beating vibratory means 15 by the downstream flow 2A. An example of this approach is disclosed in Japanese patent publication Kokai No. 3-162814 published on Jul. 6, 1990.

Approach 3

As illustrated in FIG. 1C or 1D, for example, a further approach is to direct the downstream flow 2A, as jets if desired, in a direction generally parallel to the surface F being cleaned to be drawn into an opposing suction port 3 in which the flow is created by both the forcing pressure and the suction rather than the suction alone from the atmosphere as in the non-recirculating type cleaner. The arrangement of FIG. 1C is disclosed in the aforesaid Japanese utility model publication Kokoku No. 39-36553 and Japanese utility model publication Kokoku No. 43-22616 (published on Oct. 5, 1964), for example. The arrangement of FIG. 1D is shown in Japanese patent publication Kokai No. 48-46157 (published on Oct. 1, 1971), for example.

Approach 4

As illustrated in FIG. 1E or FIG. 2B, 2C for example, a still further approach is to discharge the downstream flow 2A in the form of jet against the surface F being cleaned at an angle of 0° to 60° relative to the surface F to blow up the dust to be suctioned into an opposing suction port 3. The arrangements of FIG. 1E, FIG. 2B and FIG. 2C are disclosed in Japanese patent publication Kokai No. 48-101764 (published on Apr. 8, 1972), Japanese utility model publication Kokai No. 60-188553 (published on May 24, 1984) and Japanese patent publication Kokai No. 3-162814, respectively, for example.

Approach 5

As shown in U.S. Pat. No. 3,268,942, the outlet of the recirculated flow is located within the region of the suction port, is so constructed as to discharge the flow in the form of a jet, and the discharge angle of the jet is approximately 90 degrees relative to the surface F to be cleaned, whereby the jet may be directed toward dust entrapped at the roots of the carpet piles or in recessed grooves without increasing the back pressure of the tan to provide high cleaning efficiency as well as a high cleaning ratio at a low power consumption.

In the approaches 3 and 4, the configurations of the dust collecting port means 30 (comprising an outlet 4 and a suction port 3) may take various forms:

(A) The suction port 3 is most often located within the region of the outlet 4 as illustrated in FIGS. 1C, 1D and 2A1 (Japanese patent publication Kokai No. 58-175528). In some cases, however, the dust collecting port means 30 may comprise a one-sided outlet 4 and a one-sided suction port 3 as shown in FIGS. 1A, 1E and 2B.

(B) As illustrated in FIG. 2A2 (Japanese patent publication Kokai No. 58-175528), a single outlet 4 may be disposed within a suction port 3.

(C) In the arrangements of FIGS. 1C, 1D, 1E and 2A1, 2A2, the end surface 21 of the boundary wall between the outlet and suction regions is generally parallel to the surface F to be cleaned, and planar and smooth.

(D) As illustrated in FIGS. 2C, 2A1 and 2A2, the end surface of the outer peripheral wall of the suction region may be generally parallel to the surface F, and planar and smooth.

In none of the aforementioned prior art references is there any teaching about the distance between the dust collecting port means and the surface to be cleaned. The distance seems to be fixed as far as it is seen from the drawings of FIGS. 1A–1E and 2A–2C. In these prior art arrangements, the suction path 1T and the recirculating path 2T are separate from each other or each comprise either one of the inner and outer tubes of a double-walled tubing, and are merged at the dust collecting port means.

In the aforesaid prior art cleaners other than those shown in FIGS. 2B and 2C, the recirculating ratio (the amount of the flow discharged at the dust collecting port means by the amount of the flow downstream of the fan motor) appears to be 100%.

In the arrangement shown in FIG. 2B a regulating valve 10 is disposed in the recirculating path 2T after the downstream flow is divided into a recirculating flow 2A and an exhaust flow 2B. With this construction, it is presumed that the recirculating ratio may not exceed 50% even with the recirculating path being fully open. The regulating valve 10 may be operated either manually or by the negative pressure at the suction port.

In the arrangement shown in FIG. 2C, a two-way valve 9 is disposed at the diverting point. With this construction, the recirculating ratio may be varied from 100% to 0% although the manner of operation is not specifically described in the prior art references.

Although the temperature rise due to the recirculation of air flow may pose a problem, none of the prior art references (FIGS. 1A–1E and 2A–2C) provides any teaching about the power used to drive the fan motor, and it is thus assumed that the fan motor is powered in a conventional manner. Despite a high temperature rise expected with a 100% recirculation, most of the prior art references suggest nothing about a countermeasure, except that it is suggested that cooling means 16 be disposed in the recirculating path 2T as shown in FIG. 2C. Alternatively, it is proposed that the recirculating ratio be reduced greatly or to some extent so as to permit some fresh air to be drawn in for the cooling purpose.

As to other functions, the suction type cleaners as shown in FIGS. 1A and 1B use the power brush 12 or beating blades 15 (driven by a suction flow-powered turbine or by electric power) to vibrate or thrash a carpet to thereby loosen the dust from the piles of the carpet.

It has been found that in the prior art cleaners as described hereinabove the following subjects had problems to be solved:

a) In the prior art as shown in FIGS. 1A and 1B where the downstream flow energy is used, the arrangement for employing the downstream flow to rotate the turbine impeller 13 for the purpose of rotating the rotary brush 12 or to provide beating and vibrating actions had the disadvantages that it was not so efficient in converting the aerodynamic energy to mechanical energy that a required amount of power taken from the downstream flow would result in a build-up in the back pressure of the fan, that is, the pressure behind the fan on the side close to the exhaust port.

b) In the non-recirculating system the air drawn from the atmosphere is caused to flow parallel to the surface being cleaned to remove the dust engaged by or entrained in the air flow. The prior art shown in FIGS. 1C and 1D is an improvement over the parallel flow system in which the efficiency of loosening the dust is enhanced by moving the downstream flow 2A directly against and along the surface being cleaned toward the opposing suction port 3 so as to suction the air from the recirculating air rather than from the atmosphere. While this parallel flow system indeed proved to be superior to the non-recirculating system and the mechanical converting system, it had difficulty in satisfactorily blowing off the dust entrapped between the root portions of carpet piles as the air flow swept through only the upper half portions of the piles. Nor was it capable of blowing off dust caught in recessed grooves. It is for this reason that power brushes and the like were developed for use with the conventional suction type cleaner. But still, the bristle of the brush was not capable of reaching the roots of carpet piles or the bottoms of recessed grooves, so that the cleaning ratio was only on the order of 30% to 60% for long-pile carpets.

c) With the system (shown in FIGS. 1E, 2B and 2C) in which the downstream flow was discharged through a constricted orifice as a jet at an angle against the surface being cleaned, it was possible to deliver some portion of the air flow to the roots of carpet piles or the bottoms of recessed grooves to loosen the dust more effectively than the parallel flow system, but not sufficiently. Moreover, the air flow was discharged in one direction, so that it was hard to remove the portion of the dust entrapped behind the piles.

d) Blowing out contaminated streams and the resultant scattering of dust in a room With an arrangement having the outlet 4 for discharging the recirculated flow located at the outer periphery of the dust collecting port as illustrated in FIGS. 1C, 1D and 2A1, contaminated streams containing fine particles which have not been filtered out may undesirably escape out of a gap between the collecting port and the surface being cleaned to the surrounding atmosphere, and may also scatter the surrounding dust. Problems a) through d) above have been solved by the aforementioned approach 5. However, a problem remains to be solved, i.e., the problem that laminar objects stick easily to the cleaner head.

e) The industry has heretofore concentrated its efforts on increasing the suction force of the electric cleaner, so that laminar and pliable or deformable objects such as pieces of paper and cloth, table cloths, carpets, curtains, bedclothes and the like are apt to be drawn up or attracted against the suction port 3 due to the negative pressure, and thereby block the air flow. In the case of a robotic cleaner, this can lead to a motor burnout or an abnormal increase in resistance to the mobility of the cleaner. Of course, even when manually maneuvering the cleaner, an operator had to remove any objects suctioned against the port with the motor turned off, or had to move the cleaner while holding the object being cleaned down by his or her feet. For this reason it was practically impossible to clean sheets of paper, curtains, table cloths, thin floor coverings, bedclothes and the like.

In the recirculating type cleaner, the dust collecting port means includes an outlet and a suction port located in a common region where the positive and negative pressures are balanced with each other on the average, resulting in a reduced suction force as compared to the conventional type of cleaner. However, although the positive and negative pressures are in balance as a whole, there is locally either a positive or a negative pressure, so that a pliable object to be cleaned can possibly be drawn lightly against the suction port 3 to partially cover the port. This is ascribed to the fact that the end surface 21 of the boundary wall between the outlet and suction regions facing the surface F to be cleaned is generally planar and smooth (FIGS. 1C, 1D, 1E and 2A1, 2A2, 2B, 2C).

f) As indicated above, it is advantageous to locate the suction region at the outer periphery of the dust collecting port means. It is to be noted that the air may be drawn from the surrounding atmosphere in an amount approximately equal to the amount of the air being exhausted through the recirculation diverting valve 9. It is thus required that the recirculation ratio should not be 100%. On the other hand, the cleaning efficiency is higher with the recirculation ratio closer to 100%, as will be explained hereinafter. Accordingly, the operation should take place at an optimal recirculation ratio. However, a greater suction force may sometimes be needed as when the dust is relatively heavy and fine or when the surface to be cleaned is a smooth flooring, or when it is desired to pick up ticks from underneath the outer surface of 'tatami' mats (Japanese straw made mats) or carpets. Conversely, it may be desirable to have a stronger jet in order to clean a long-piled carpet, for example. For this reason, it is desirable to control the recirculation ratio (the maximum suction at a ratio of 0% and the strongest jet at a ratio of 100%).

FIG. 2B is an example of the conventional recirculation ratio variable system. It is presumed that such system may regulate the recirculation ratio up to 50%, which is insufficient to provide a satisfactory efficiency. In addition, the means for adjusting the valve 10 is mechanical and operated manually or by a negative pressure at the suction port. The system shown in FIG. 2C is capable of approximately 100% to 0% regulation, although the method of controlling the regulating valve 9 is not described in the prior art references. Neither of the systems shown in FIG. 2B and FIG. 2C permits the operator to control the recirculation ratio in a convenient manner during the cleaning operation.

In addition, the recirculating type cleaner had the disadvantages that, since the air stream from the outlet is discharged to the atmosphere when the dust collecting port means is not in facing opposition to the surface to be cleaned, the surrounding dust may be blown up as the dust collecting port is moved too close to the surface to be cleaned.

g) In the recirculating type cleaner, it is required to adjust the distance between the dust collecting port and the surface to be cleaned, as is the case with the conventional type cleaner. But, all of the prior art recirculating type cleaners as described above are incapable of adjustment of said distance.

SUMMARY OF THE INVENTION

According to a first aspect of the invention in addition to producing an efficient and ideal jet of the recirculated stream by locating the jet outlet within the region of the suction port and directing the jet approximately perpendicularly to the surface F to be cleaned, the outer bounds of the jet region are surrounded by the suction region to prevent contaminated downstream flow from escaping out of the collecting port means.

According to a second aspect of the invention, the end surface of the boundary wall between the outlet and suction port facing the surface to be cleaned is formed with a plurality of narrow channels extending through said wall to communicate the outlet and suction port, and likewise the end surface of the outer peripheral wall of the outlet outward of the suction port facing the surface to be cleaned is formed with a plurality of narrow channels extending through said wall to communicate the suction port with the atmosphere, in order to assure that laminar and pliable objects are more positively prevented from being drawn up against the suction port.

According to a third aspect of the invention, pressure sensor means are provided for detecting the pressure in a dust collecting chamber, a valve means is provided in a short-circuit passage connecting a suction flow path with a recirculating path, and the valve means is actuated automatically in response to a change in the suction pressure.

BRIEF DESCRIPTION OF THE DRAWINGS

These and other more detailed and specific objects and features of the present invention will be more fully disclosed in the following specification with reference to the accompanying drawings, in which:

FIG. 2A1 and 2A2 are cross-sectional views of still another prior art recirculating type cleaner showing a pertinent part thereof;

FIG. 2B is a cross-sectional view of another prior art recirculating type cleaner showing a pertinent part thereof;

FIG. 2C is a cross-sectional view of yet another prior art recirculating type cleaner showing a pertinent part thereof;

DETAILED DESCRIPTION OF THE PREFERRED EMBODIMENTS

Figure 1B:
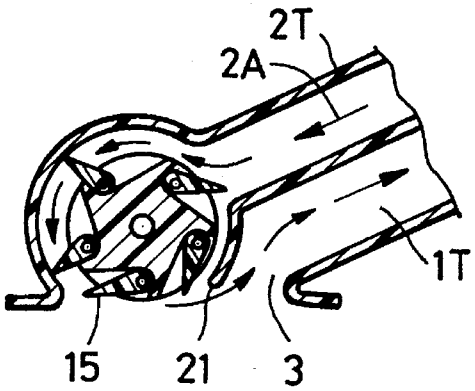
FIG. 1B is a cross-sectional view of another prior art recirculating type cleaner showing a pertinent part thereof.
Figure 1A:
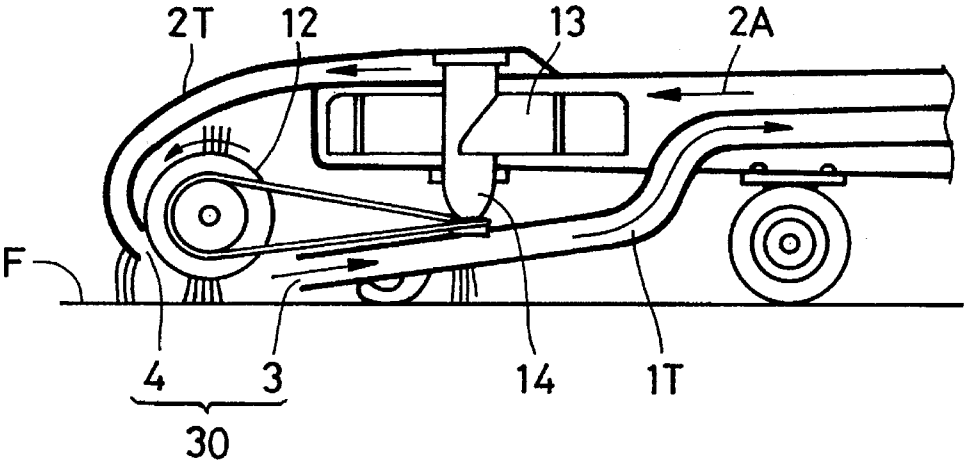
FIG. 1A is a cross-sectional view of a prior art recirculating type cleaner showing a pertinent part thereof.
Figure 1E:
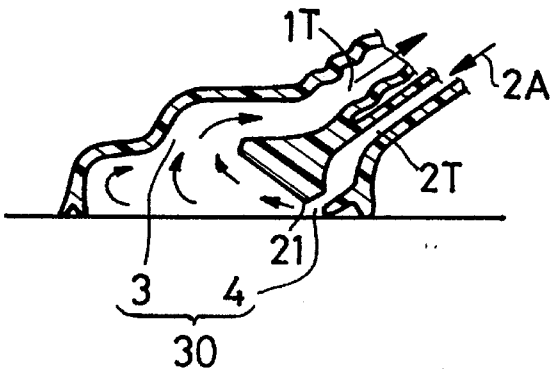
FIG. 1E is a cross-sectional view of another prior art recirculating type cleaner showing a pertinent part thereof.
Figure 1D:
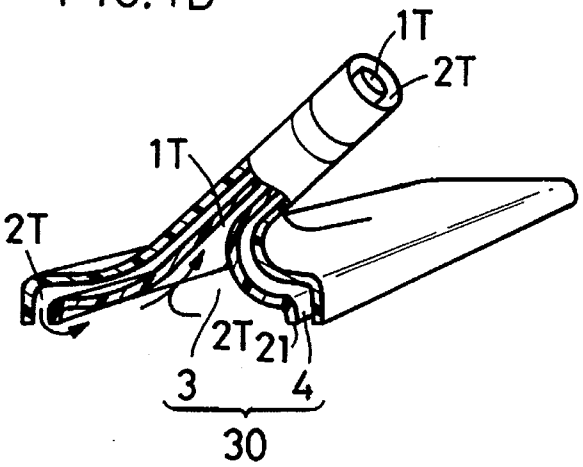
FIG. 1D is a cross-sectional view of yet another prior art recirculating type cleaner showing a pertinent part thereof.
Figure 1C:
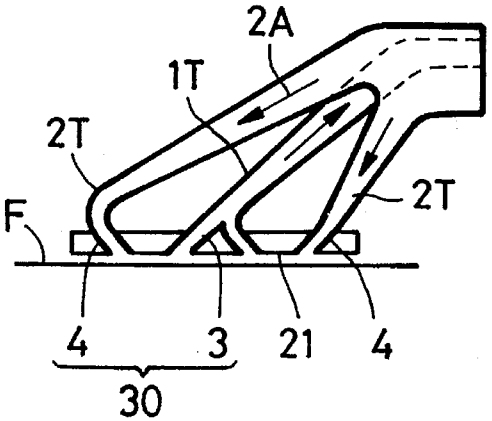
FIG. 1C is a cross-sectional view of still another prior art recirculating type cleaner showing a pertinent part thereof.
Figure 3A:
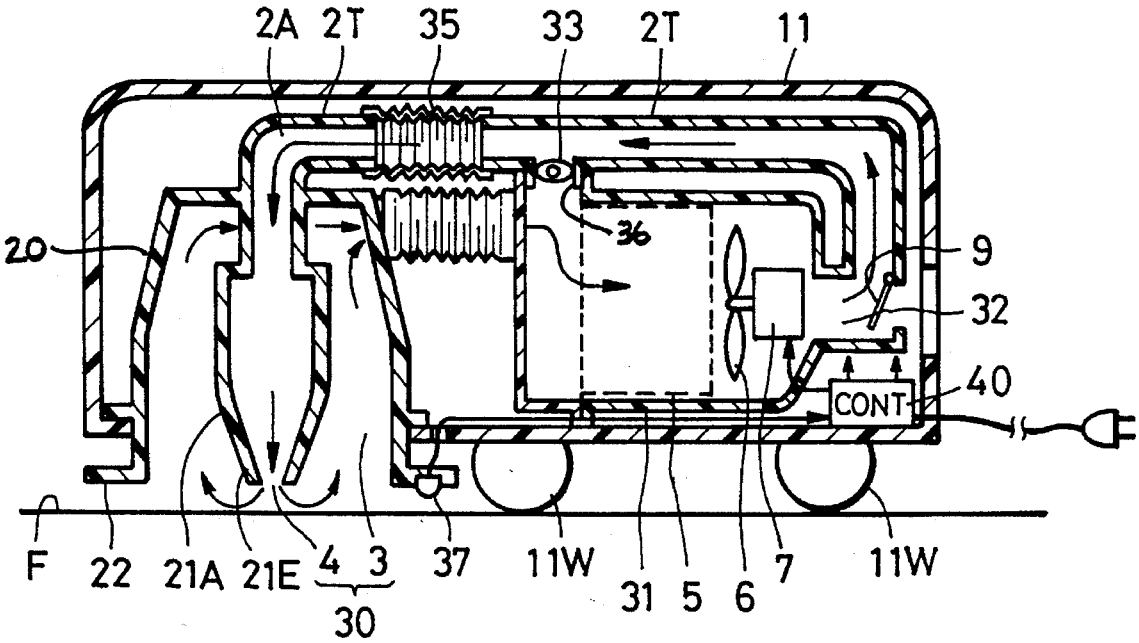
FIG. 3A is a cross-sectional view of principal parts of one embodiment of the recirculating type cleaner according to the present invention.
Figure 3B:
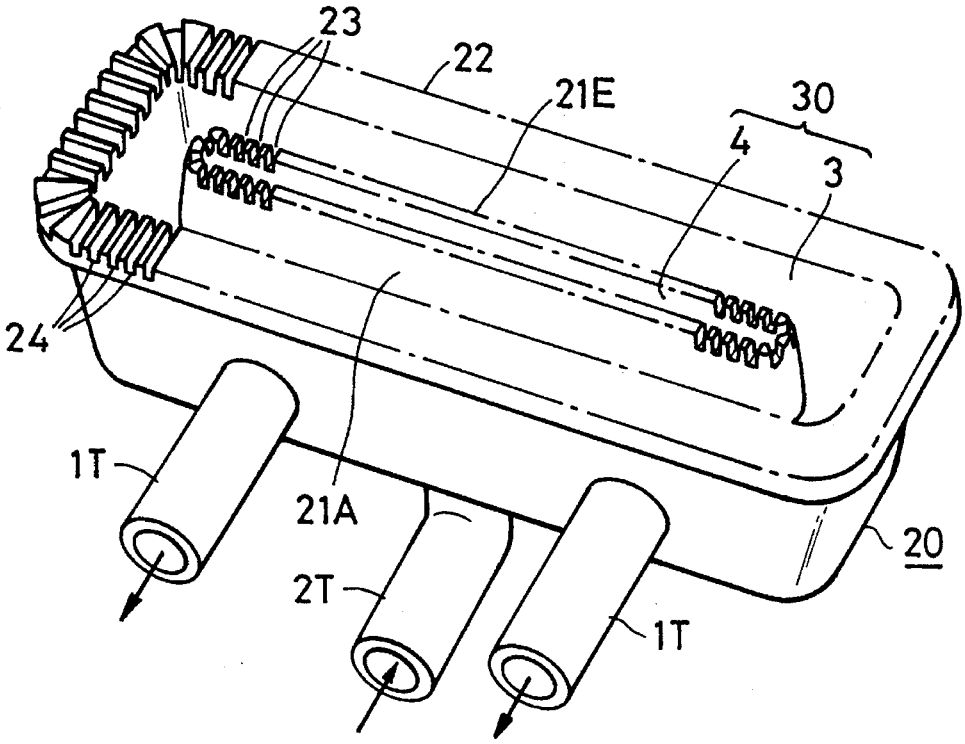
FIG. 3B is a perspective view of the dust collecting head of the cleaner shown in FIG. 3A.

Referring to FIG. 3A, a first embodiment of the recirculating type cleaner according to the present invention is shown in a vertical cross-sectional view. The dust collecting head 20 which is a principal part of the cleaner is shown in FIG. 3B in a perspective view as viewed from the bottom. In this embodiment the dust collecting head 20 is inserted in a cleaner housing 11 from the bottom opening thereof and mounted in the housing. The head 20 comprises a central jet nozzle 21A terminating in an outlet means 4 for discharging recirculating flow at the lower end thereof. The upper end of the jet nozzle 21A is connected via a recirculating tube 2T with a rear conduit 32 leading from a dust collecting chamber 31. Mounted in the dust collecting chamber 31 adjacent the rear conduit 32 is a motor 7 which drives a fan 6 to create a vacuum or a negative pressure in the chamber 31.

A filter 5 is accommodated in the chamber 31 which is in fluid communication with a suction port 3 of the dust collecting head 20 via a suction tube 1T on the side of the open forward end of the filter 5.

As shown in FIGS. 3A and 3B, the jet nozzle 21A is tapered in cross section toward the lower end to define a constricted orifice such that the direction of discharge is approximately normal to the lower end plane of the suction port 3 so as to produce a jet in a direction perpendicular to the surface F to be cleaned. The peripheral wall of the jet nozzle 21A defines a boundary wall to separate the suction port 3 from the outlet means 4.

The outlet means 4 may comprise a single jet as shown in FIG. 3B or a plurality of jets. The outer peripheral wall of the dust collecting head 20 separates the outlet means 4 from the atmosphere. The lower end of the outer peripheral wall is turned outwardly to define a flange 22 extending parallel to the the surface or floor F to be cleaned.

Wheels 11W support the cleaner so as to maintain a spacing the between the flange 22 and the surface F to be cleaned. The distance between the flange 22 and the surface F to be cleaned may be automatically adjusted by moving the dust collecting head 20 vertically by a drive means (not shown). Such drive means may be actuated under the control of a controller 40 which is operative in response to a signal representing the said distance as detected by an optical or ultrasonic sensor 37. The sensor 37 may be mounted on the flange 22 as illustrated. The recirculating tube 2T and suction tube 1T may include flexible joint tubes 35 and 36, respectively intermediate their opposite ends.

In use, the vertically directed jet impacts the surface F being cleaned and parts forward and rearward (right and left as viewed in FIG. 3A) to blow up the dust. Now considering one point on the surface F being cleaned, as the dust collecting port means (comprising the outlet means 4 and the suction port means 3) is moved forwardly (from right to left as viewed in FIG. 3A) in its forward sweeping stroke, said point first enters the region of suction port 3 where it is exposed to the air flow from rearward, then it moves to directly under the outlet 4 where it is exposed to the air jet from above, and moves on until it again enters the region of suction port 3 where this time it is exposed to the air flow from the left. In this way any point on the surface being cleaned is evenly exposed to the air flow from all directions, so that a thorough cleaning of a carpet and the like may be expected.

If the discharge angle of the jet were less than 60°, the air jet would blow from only one direction, with the result that some of the dust would be likely to remain unremoved. In contrast, according to this embodiment of the invention the jet is directed generally perpendicularly against the surface being cleaned, whereby the air flow may reach the roots of the carpet piles or the bottom of recessed grooves to blow up and loosen the dust at the roots or the bottom. Producing such an air jet does not cause large build-up of the fan back pressure, but makes it possible to utilize the energy of the downstream flow (air flow downstream of the suction fan) more effectively than a mechanical brush or beating means.

Following are the results of experiments conducted on the dust collecting port means illustrated in FIG. 3A (which is a cross-sectional view taken vertically through the recirculating tube 2T). These experiments were conducted on a recirculating type cleaner which was modified from a commercially available non-recirculating type cleaner operable at an apparent power of 900 W and adjustable in power between seven steps. The discharge angle of the recirculated jet relative to the floor surface was about 90°. The dust collecting port means was constructed as illustrated in FIG. 3A. A cleaning test was made on a floor having a straight groove extending at 45° with respect to the sweeping direction of the cleaner according to JIB C-9108. The amount of sand removed from the groove was measured. With the cleaner according to this invention the amount of sand removed per unit air power was 2.4 times as much as that of the conventional cleaner. In addition, an increase by a factor of 1.6 in the electric power to air power conversion efficiency was obtained by adjusting the power for the same fan motor. It was thus found that in total the cleaning amount per unit electric power or the cleaning efficiency was 3.84 times as much as that of the conventional cleaner.

Another test was made on a carpet having sand scattered at the roots of the carpet piles, and it was found that 2 or 3 times as much cleaning efficiency was obtained.

These values of cleaning efficiency were achieved in the case where the recirculation ratio was about 100% , in which the temperature rise of the fan motor might pose a problem. However, a satisfactory cleaning efficiency may be realized even if the power to the fan motor is reduced to less than 80%, to about 1/3.84, for example. Accordingly, it is possible to keep the temperature rise of the fan motor down to below the specified level. It is thus to be appreciated that the cleaner having a jet at 90 degrees according to this invention is superior to the conventional cleaner with the power brush system or the jet system having a discharge jet angle less than 60°.

When the dust collecting port means is covered by pliable laminar objects such as pieces of paper, cloth and plastic film (representatively referred to as "paper" hereinafter), such objects may not be drawn up against the outlet means 4 which is at a positive pressure, but possibly against the suction port 3 which is at a negative pressure. It has been found by experiments that a drawn up piece of paper would be blown downwardly into a generally arcuate shape at the central outlet means 4 while being drawn up generally flat against the opposed sections of the suction port 3, whereby the air jet will escape out through the opposed end openings defined at the opposed end of the arcuate portion of the paper piece while the suction port 3 would be blocked, were it not for channels 23, 24 as will be described below.

In consideration of this, according to the invention, the lower end surface 21E of the jet nozzle 21A is formed over its full periphery with narrow channels 23 establishing fluid communication between the outlet means 4 and the suction port 3, and likewise the end surface of the flange 22 is formed with narrow channels 24 communicating the suction port 3 with the atmosphere, as illustrated in FIG. 3B. With this construction, a piece of paper will not be fully drawn up against the end surface 21E as some of the discharged jet will flow through the multiplicity of channels 23 into the suction port 3 to minimize the pressure to draw up the paper piece. Likewise, there is little suction pressure between the paper piece and the flange 22 due to the multiplicity of channels 24 communicating the suction port 3 with the atmosphere. The possibility of a paper piece being drawn up against the dust collecting port means 3, 4 is thus minimized.

The width of each channel 23, 24 is sized to be sufficiently small relative to the depth thereof so that, should a piece of paper be drawn up against the dust collecting port means, any possibly bent portion of the paper piece would be prevented from entering the channel to block the latter. In addition, in order to eliminate the trouble of turning off the power or holding a paper piece down by the operator's feet in the unlikely event of drawing a piece of paper, it is possible to provide a short circuit valve 33 (FIG. 3A) in a short-circuiting passage 36 connecting the recirculating tube 2T with the dust collecting chamber 31 in an upstream region with respect to the fan 6 whereby the pressure to draw up any laminar pliable object may be selectively turned on and off. The short-circuit valve 33 may be actuated automatically in response to a change in the suction pressure.

The region of suction port 3 is under the influence of suction. When the recirculation ratio is less than 100%, the external air is drawn in through a gap between the flange 22 and the surface F at a rate corresponding to the difference with respect to 100% The air recirculating in a closed loop is thus prevented from flowing out of the dust collecting port means 30 and blowing up external dust in the surrounding area.

In the embodiment described above, when the dust collecting port means 30 is in closely facing relation to the floor surface F being cleaned, the jet will impact on the floor surface F and divides into right and left streams to be drawn into the suction port 3. However, when the port means 30 is moved away from the floor surface F, the air jet will spout into the intervening space, blowing up dust on the floor without collecting most of the dust. It is, therefore, desirable to provide one of the following controls: the fan motor 7 is turned OFF or ON by the control means 40, or the diverting valve 9 is actuated by the control means 40 to open the rear outlet to turn down the recirculation ratio or close it to fully recirculate the air, or the short-circuit valve 33 is actuated by the control means 40 to connect or shut out the region between the recirculating path 2T and the dust collecting chamber 31, or the diverting valve 9 is actuated by the control means 40 to close the recirculating path 2T (and therefore open the rear outlet) to cause operation in a suction mode or to close the rear outlet to cause operation in a recirculating mode.

To this end, a sensor 37 may be mounted on the flange 22 as illustrated in FIG. 3A to detect the distance of the flange 22 from the surface F to be cleaned so that the power supply to the fan motor 7 may be cut off, or either the diverting valve 9 or the short-circuit valve 33 may be operated under the control of the controller 40 in response to the detected distance.

As stated hereinbefore, the conventional non-recirculating cleaner is apt to draw up laminar, pliable objects (such as pieces of paper) against the suction port 3 by a powerful suction force. As a result, the amount of air being suctioned may be reduced approximately to zero, so that the motor is liable to be overheated without being cooled by the air. When cleaning a carpet or the like, the carpet piles are drawn up against the suction port to present a high resistance to the mobility of the cleaner, even though laminar objects are not attracted. These phenomena would be a great obstacle if the cleaner is to be robotized or automated for an unmanned operation.

In contrast, with the recirculating type, the positive and negative pressures are balanced with each other on the average, eliminating the problem of drawing laminar objects and resistance to the mobility of the cleaner, as stated before. However, locally there is still some possibility of laminar objects being drawn up against the suction port which is at a negative pressure, although no such phenomenon may occur at the outlet port which is at a positive pressure. In view of this, channels or grooves may be formed in the embodiment of FIG. 3B in the under surfaces of the nozzle 21A and or flange 22. With such channels, if a piece of paper attaches locally to the suction port 3, no significant suction pressure is exerted on the paper piece as there is air flow between the paper and the end surface 21E and between the paper and the flange 22 through the channels whereby the paper attraction, and hence an increase in resistance to the mobility of the cleaner, are prevented.

Advantages of the invention

1.) The jet flow directed generally perpendicularly to the surface to be cleaned is capable of easily reaching the bottoms of minute grooves or roots of carpet piles. Further, no portion of the surface being cleaned may be shielded from the air jet by moving the dust collecting port means, thereby greatly enhancing the cleaning efficiency.

2.) The outlet port for jetting the recirculated downstream flow is surrounded by the suction port, whereby the air jet is prevented from scattering dust.

3.) It is possible to prevent laminar (sheet-like) objects such as paper, cloth, tablecloth, floor coverings and the like from adhering to the dust collecting port means by providing minute channels 23 or 24 in the end surface 21E of the outer peripheral wall of the outlet 4 or the flange 22 circumscribing the suction port.

4.) According to the present invention, cleaning efficiency 2 to 3 times as much as that of the conventional system may be obtained in the recirculating type cleaner. Accordingly, if the electric power supply is reduced to one-half to one-third of that required of the conventional cleaner, the temperature rise of the fan motor may be kept down even at a recirculation ratio close to 100%.

5.) The provision of minute grooves 23, 24 in the end surfaces of the dust collecting port means to prevent adherence of laminar objects and hence obstruction to the mobility on a carpet facilitates realization of a cordless and hoseless robotized cleaner, in addition to reducing power consumption as mentioned above.

What is claimed is:

1. A recirculating type cleaner comprising:

a dust collecting port means including a suction port and an outlet means in which downstream flow of a fan disposed at the rear of a dust collecting chamber is recirculated through a recirculating flow path to said outlet means, discharged through an outlet port in said outlet means, and drawn from said suction port into said dust collecting chamber through a suction flow path;

said dust collecting port means having an outer peripheral wall which defines an outer boundary of said suction port;

said outlet means being located within the region of said suction port and having an orifice constructed to discharge the downstream flow in the form of a jet and so oriented as to discharge the jet at an angle in the range of 90°±30° relative to a surface to be cleaned; and said outlet port and said suction port being separated from each other by a boundary wall having an end surface adjacent the surface to be cleaned, the end surface of said boundary wall being formed with a plurality of minute channels to communicate the outlet port with the suction port thereby to permit passage of air from the outlet port to the suction port.

2. A recirculating type cleaner comprising:

a dust collecting port means including a suction port and an outlet means in which downstream flow of a fan disposed at the rear of a dust collecting chamber is recirculated through a recirculating flow path to said outlet means, discharged through an outlet port in said outlet means, and drawn from said suction port into said dust collecting chamber through a suction flow path;

said dust collecting port means having an outer peripheral wall which defines an outer boundary of said suction port;

said outlet means being located within the region of said suction port and having an orifice or opening so constricted as to discharge the downstream flow in the form of a jet and so oriented as to discharge the jet at an angle in the range of 90°±30° relative to the surface to be cleaned; and said outer peripheral wall having an end surface adjacent the surface to be cleaned, an end face of said outer peripheral wall being formed with a plurality of minute channels to communicate the surrounding atmosphere with the suction port thereby to permit passage of air from the atmosphere to said suction port.

3. A recirculating type cleaner according to claim 1 or 2, wherein the width of each of said channels is sized relative to the depth thereof so that a deformed portion of any laminar pliable object that may stick to the dust collecting port means is prevented from entering the channel.

* * * * *